United States Patent [19]

Haug

[11] Patent Number: 4,739,701

[45] Date of Patent: Apr. 26, 1988

[54] FRANKING MACHINE WITH PRINTING PLATE CHANGING APPARATUS

[75] Inventor: Werner Haug, Langnau, Switzerland

[73] Assignee: Frama AG, Lauperswil, Switzerland

[21] Appl. No.: 17,755

[22] Filed: Feb. 24, 1987

[30] Foreign Application Priority Data

Mar. 5, 1986 [CH] Switzerland ..... 905/86

[51] Int. Cl.[4] ..... B41L 29/00

[52] U.S. Cl. ..... 101/91; 101/378

[58] Field of Search ..... 101/91, 378, 109, 110; 400/171; 235/101

[56] References Cited

U.S. PATENT DOCUMENTS

| | | | |
|---|---|---|---|
| 2,953,090 | 9/1960 | Scott | 101/378 |
| 3,869,986 | 3/1975 | Hubbard | 101/91 |
| 3,890,491 | 6/1975 | Malavazos et al. | 235/101 |
| 3,892,303 | 7/1975 | Willcox | 400/171 |
| 4,520,725 | 6/1985 | Haug | 101/91 |

*Primary Examiner*—Clifford D. Crowder

*Attorney, Agent, or Firm*—Ladas & Parry

[57] ABSTRACT

In order to be able to simply and rapidly replace a printing plate on the franking head of a franking machine without the hands or the surrounding area being exposed to a risk of dirtying, an automatic change mechanism is provided in the franking head, as well as in and on an interchangeable magazine. An electromotive drive bring about the disengagement and discharge of the printing plate from the franking head into the circumferentially fixed, but detachably secured magazine. Ratchet levers and ejecting levers mounted in the franking head are used for this purpose. These levers are driven by cam bodies, while a similar group of stop levers and delivery levers mounted in the interchangeable magazine is operated by electromagnets. An ejecting lever loaded by a spring presses against the back of the cassette, so that after the release of a latching means the cassette is moved out by means of a pawl on guide bolts. It can then be removed in simple manner with the printing plate enclosed therein and can be replaced by another interchangeable magazine with another printing plate.

13 Claims, 4 Drawing Sheets

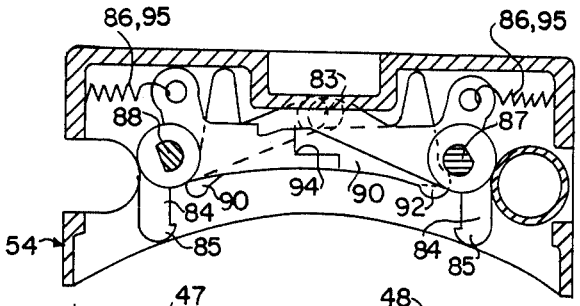
FIG. 4
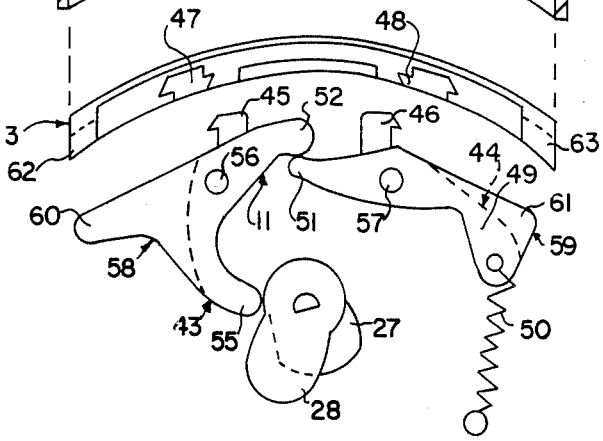
FIG. 5
FIG. 6
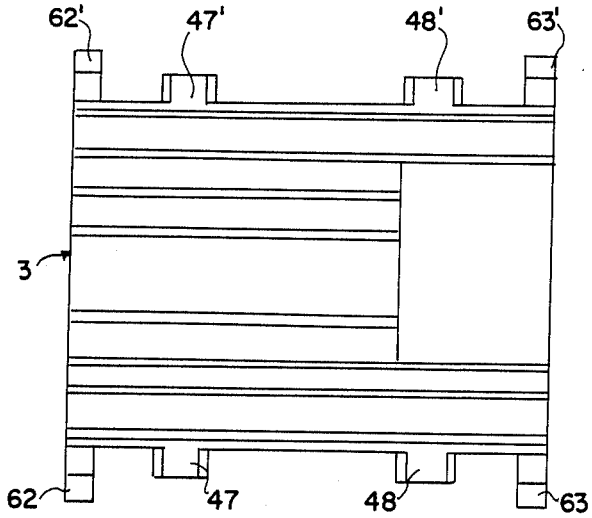
FIG. 7

FRANKING MACHINE WITH PRINTING PLATE CHANGING APPARATUS

BACKGROUND OF THE INVENTION

The present invention relates to a franking machine, on whose franking head at least one further printing means is provided, in addition to a set of franked value or stamp type wheels.

As is known, a franking machine, apart from the franked value impression, makes further impressions, e.g. the type of dispatch, the place of posting, the sender and advertising information on the item to be franked. The use of a selection printing roller in the franking head of the franking machine makes it possible to effect an easy change between different impressions, without manual manipulations being required on the machine. However, this change is limited to predetermined, areally restricted impressions. DE-C-29 32 426 gives an example of the drive of such a selection printing roller. However, for changing advertising impressions, which are typically only required for a limited time, such as e.g. for a trade fair or for referring to other events, it is necessary to manually replace the printing plate fixed to the franking head. It is hardly possible to carry out this work without the hands being made dirty by the printing ink.

SUMMARY OF THE INVENTION

The problem of the present invention is to provide a franking machine permitting rapid, easy replacement of a printing plate on the franking head, without there being any risk of dirtying for the user or the surrounding area.

According to the invention this problem is solved by a franking machine, which is characterized in that a printing plate is detachably held on the franking head by means of a latching means operable by a drive system.

BRIEF DESCRIPTION OF THE DRAWINGS

The invention is described in greater detail hereinafter relative to non-limitative embodiments and the attached drawings, wherein is shown:

FIG. 4, a cross-section through the empty magazine along line IV—IV in FIG. 3,

FIG. 5, a side view of the printing plate,

FIG. 6, a separate view of the ratchet lever and ejection lever mounted in the franking head, together with the associated driving cams, FIG. 7, a plan view of the printing plate according to FIG. 5, FIG. 8, a cross-section along line IIX—IIX in FIG. 2.

DETAILED DESCRIPTION OF THE PREFERRED EMBODIMENTS

Figure 1:
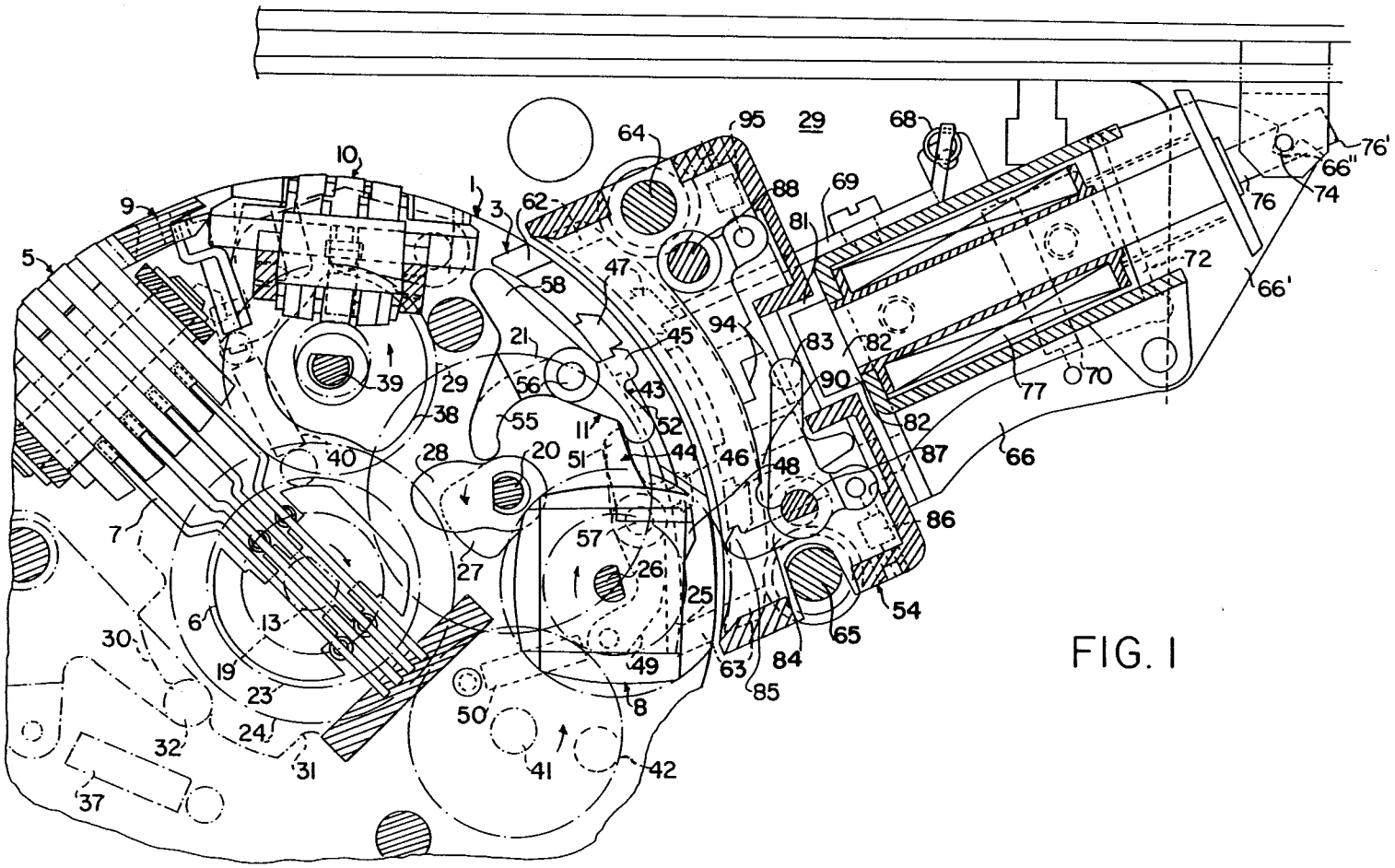
FIG. 1, an incomplete cross-section at right angles to the major axis of the franking machine for illustrating part of the franking head together with a magazine or cassette and a delivery mechanism, FIG. 2, an incomplete plan view of the franking machine in the vicinity of its franking head, FIG. 3, a plan view of the back of the empty magazine.
Figure 2:
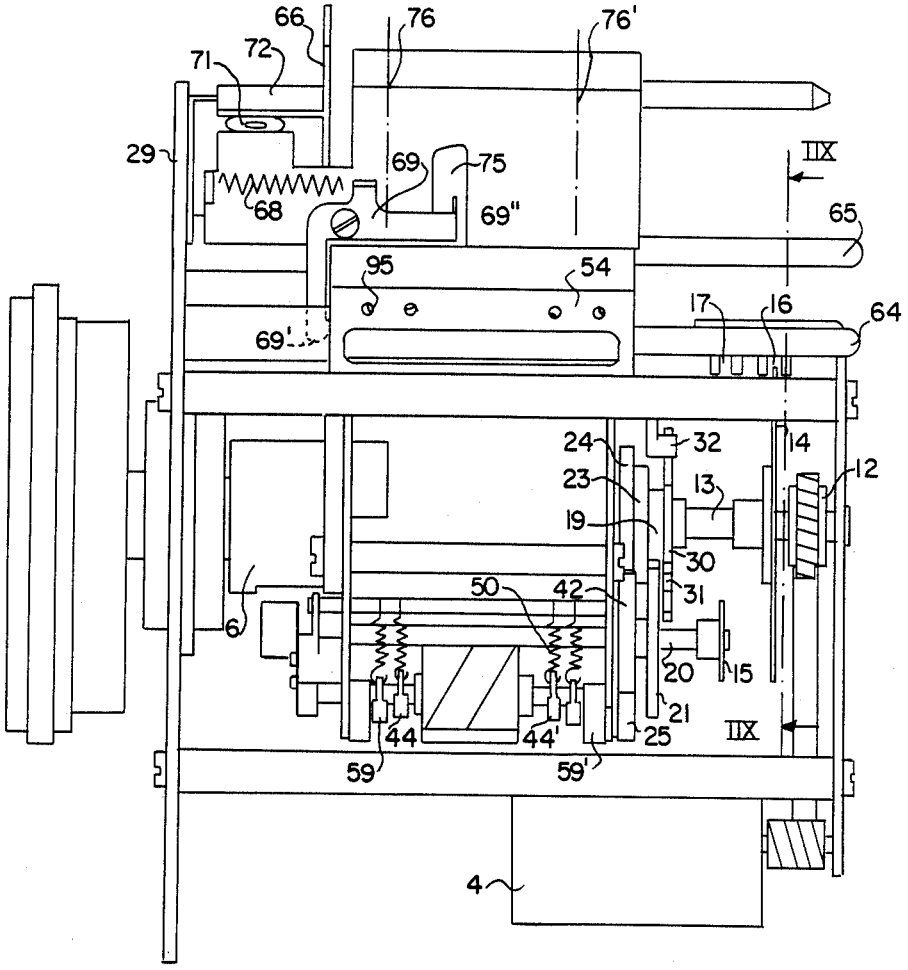
Figure 8:
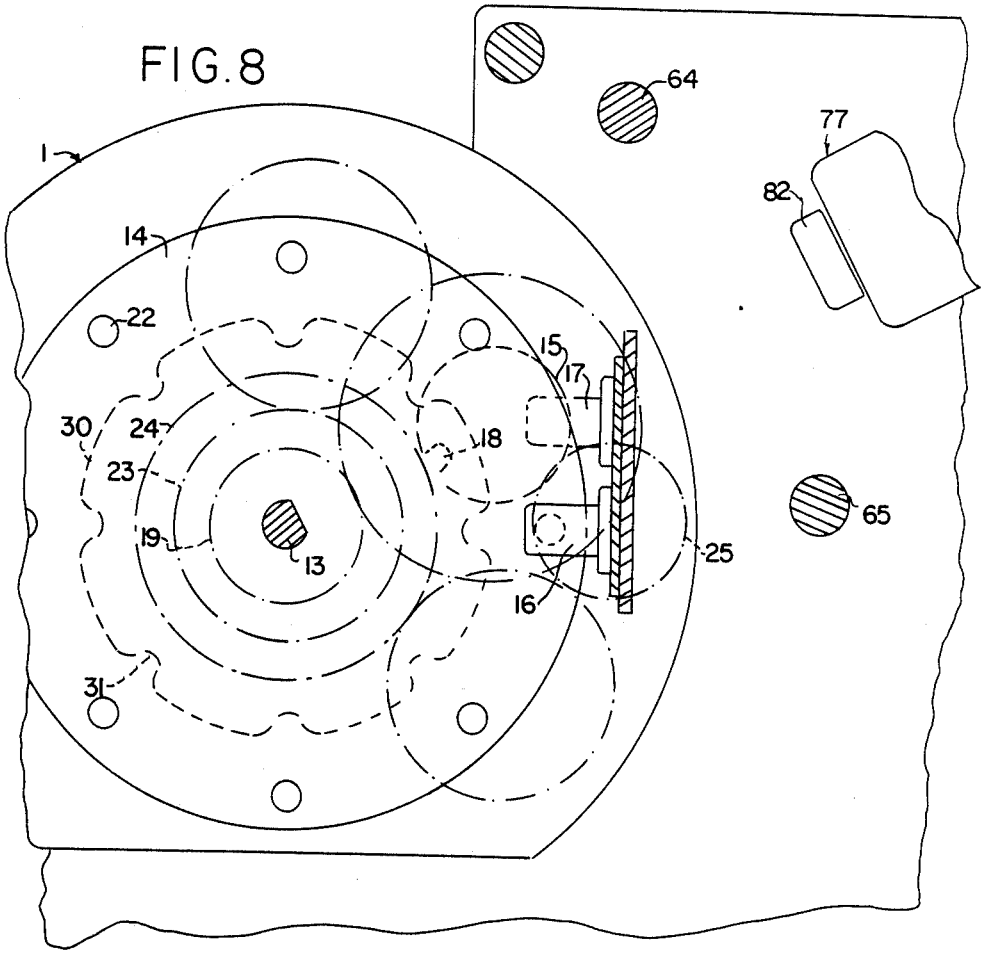

The franking head 1 has a set 5 of franked value or stamp type wheels, which are adjustable by means of racks 7 guided in the main shaft 6 and whereof a possible embodiment is described in U.S. Pat. No. 4,520,725.

In addition, franking head 1 carries a selection printing roller 8, a stamp 9 for the method of dispatch movable into an active position, as well as a date printer 10 which is adjustable by driving rams arranged outside the franking head 1, as described in U.S. Pat. No. 4,520,725.

The per se known printing means 5 and 8, i.e. movable stamp 5 and selection printing roller 8, can be adjusted into the desired positions by a common drive 4, via a one-way clutch 12, together with a mechanism 11 provided in franking head 1 for the detachable mounting of printing plate 3. This adjustment takes place automatically, in that the rotary movement of the associated common drive shaft 13 required for the individual positions are indicated to control electronics for switching drive 4 by means of two signal disks 14, 15 and photoelectric cells 16, 17 scanning the same. The smaller signal disk 15 has only one gap 18 passing photoelectric cell 17 and only rotates once during two revolutions of the common shaft 13, so that the first position changes taking place through a second revolution of shaft 13 can also be indicated back to the control electronics. For this purpose, the smaller signal disk 15 is fixed to the same shaft 20, which is driven by the twice larger gear 21 of gear pair 19, 21, in order to operate mechanism 11 for the detachable mounting of printing plate 3. For scanning the rotary movement of shaft 13, eight holes 22 are provided on the circumference of the larger signal disk 14 and pass photoelectric cell 16.

There are three gears 19, 23, 24, as well as a locking gear 30 on common shaft 13, which runs equiaxially to the main shaft 6 of the franking machine. Gear 30 by the engagement of a pressure roll 32 loaded by a spring 37 in its eight recesses 31 mechanically precisely ensures the controlled adjustment positions or rotation positions of gears 19, 23, and 24. There is a comparable ensuring of positioning for the selection printing roller 8 provided on the end of shaft 26 carrying selection printing roller 8 opposite to gear 25.

By means of gear 21, gear 19 drives the cam shaft 20 of mechanism 11 carrying the two cam bodies 27, 28 for the detachable mounting of printing plate 3. The next larger gear 23 on common shaft 13 is in engagement with gear 29 for driving a cam body 38 on cam shaft 39 for the movement of stamp 9 counter to the tension of a tension spring 40 into a radially outer, active position or a radially inner, non-stamping position. The largest of these equiaxial gears 19, 23, 24 is in engagement with an intermediate gear 42 for driving gear 25 on shaft 26 of selection printing roller 8. All these gears are mounted by means of their associated shafts 20, 39, 41 and 26 on franking head 1 and consequently perform with the operating movement thereof a circular movement, not themselves rotating about their geometrical axis. Correspondingly there is no rotation relative to franking head 1 during the rotation thereof of gears 19, 23, 24 fixed to shaft 13. This is made possible by the aforementioned one-way clutch 12.

Printing plate 3 is held on the circumference of franking head 1 by means of two ratchet levers 43, 44, in that the hooks 45, 46 thereof engage pairwise behind the hook means 47, 48 or 47', 48' laterally provided on printing plate 3. Both ratchet levers 43, 44 or 43', 44' are kept under pretension in the engagement position with printing plate 3, in that one of the ratchet levers (44) is pretensioned by a tension spring 50 acting on its arm 49 and same engages with its other arm 51 below the arm 52 of the other ratchet lever 43. Hooks 45, 46 are bevelled toward the outside and a corresponding bevel on the underside of hook means 47, 48 of printing plate 3 allows the ratchet levers 43, 44 to resiliently pivot back when the printing plate is pressed out of cassette or magazine 54 against franking head 1 and is brought into engagement there.

For the release of printing plate 3 and transfer to magazine 54 ratchet levers 43, 44 can also be pivoted back into the release position by the leading cam body 27, in that on same bears an arm 55 of the ratchet lever 43 below which engages the other ratchet lever 44, so that the latter is also pivoted.

In the same way as the ratchet levers 43, 44 cooperation therewith takes place by ejecting or ejection levers 58, 59; 58' 59' arranged on identical spindles 56, 57, so that with the exception of the outer ejecting arm 60, 61 thereof they have the same shape as the ratchet levers 43, 44; 43', 44' and consequently partly coincide in FIGS. 1 and 6. The broken lines show the boundary up to which the ratchet levers 43, 44 have the same contour as ejecting levers 58, 59. They also differ through the hooks 45, 46, which are only located on ratchet levers 43, 44. Ejecting levers 58, 59; 58', 59' are operated by the trailing cam body 28, which pivots the two ejecting levers to such an extent that by pressing against the edges 62, 63; 62' 63' or corners of printing plate 3, they press the latter away from franking head 1 and into magazine 54 until engagement takes place therein.

Magazine 54 able to receive printing plate 3 is engaged on two parallel bolts 64, 65 fixed to the franking machine housing 29 and which runs parallel to the main shaft 6 of the franking machine and are locked in this position, in that a pawl 66 engages in a hook 67 located on one end face of magazine 54. One end 69' of an ejecting lever loaded by a tension spring 68 presses against this end face of magazine 54, so that the latter slides outwards on bolts 64, 65 when pawl 66 releases hook 7. The release movement of pawl 66 is initiated by an electromagnet 71 against the tension of a tension spring 70 and for this purpose a hinged armature plate 72 is shaped onto pawl 66.

The position of pawl 66 and ejecting lever 69 is indicated by photoelectric cells 74, 75 to the control electronics, so that it is ensured that printing plate 3 is only ejected into magazine 54 when the latter is completely engaged. If no magazine is inserted, the signal arm 69'' is located in the light path of the photoelectric cell 75 and the light path of photoelectric cell 74 is blocked by signal disk 66', because in the locked position the light path of photoelectric cell 74 is freed by a cutout 66'' of signal disk 66'.

The path of movement of the armature rod 76 of one of e.g. two parallel electromagnets 77 passes through the light path of a photoelectric cell, which is e.g. positioned equiaxially to photoelectric cell 74. If the outer end 76' has passed the light path of the photoelectric cell, then the central control electronics is informed that the armature rod 76 has performed a complete lifting motion, so that it has completely rejected printing plate 3 from magazine 54 and has exerted pressure up to latching against franking head 1.

During their lifting motion into openings 81, 81' of the magazine wall, the head 82 of the two armature rods 76 meet the end 83, 83' of stop levers 84, 84' fixed to shafts 87, 88 and in each case provided in pairs and consequently pivot the latch 85 thereof, with which is latched the outer part of a hook means 47, 48; 47', 48' of printing plate 3, against the tension of a tension spring 86 into the release position. The synchronous action of the two armature rods 76, 76' for the simultaneous release of all the hook means 47, 48; 47', 48' is ensured by fixing the four stop levers 84, 84' to shafts 87, 88.

Figure 3:
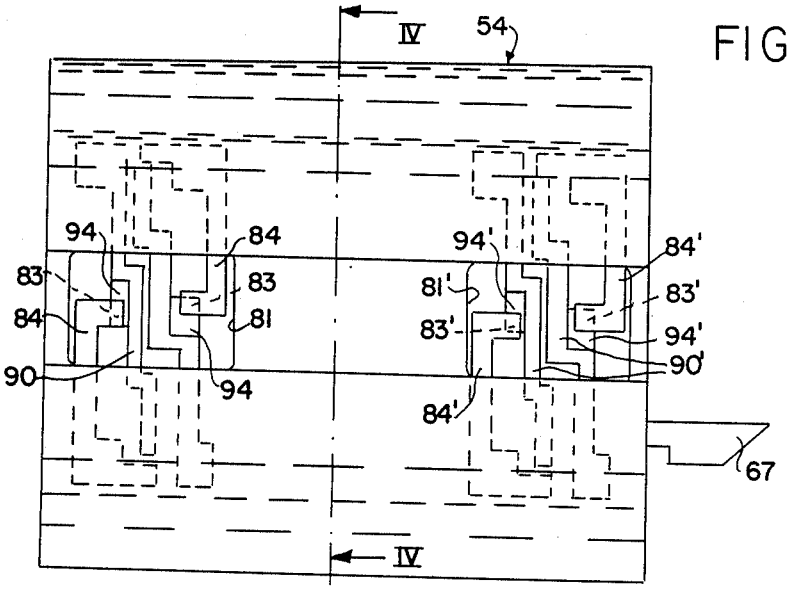

Shafts 87, 88 are also used for the pivotable mounting of delivery levers 90 thereon, which are also arranged in pairs and symmetrically to one another. The pivoting movement of these delivery levers 90 results from the earlier start of the pivoting movement of the stop levers 84, 84' also provided in magazine 54, in that the end 83, 83' thereof or a pin fixed thereto (FIG. 3) strikes a point provided in the central region of delivery levers 90, 90', e.g. a step 94, after the armature rods 76, 76' have pivoted lever ends 83, 83' by a path adequate for moving the latches 85 out of engagement with the hook means 47, 48; 47', 48' of printing plate 3. Springs 95 hold the particular delivery lever 90 in its starting position, in which its projection 92 engages on shaft 87, 88.

What is claimed is:

1. A franking machine whose franking head carries a set of franked value type wheels and at least one further printing means, said franking machine comprising;
   - a printing plate detachably held on said franking head;
   - latching means connecting said printing plate to said franking head;
   - a drive system by means of which said latching means are operable;
   - a detachably secured magazine arranged in a stationary manner for receiving said printing plate is arranged in a stationary manner on the circumference of the franking head, said magazine including a mechanism for the detachable mounting of the printing plate; and
   - a delivery mechanism for the automatic transfer of the printing plate from the magazine to the latching means of the franking head.

2. A franking machine according to claim 1, wherein the mechanism for the detachable mounting of the printing plate in the magazine has a stop lever with a latch fixed to a shaft and the delivery mechanism has at least one electromagnet with an armature rod for contact with one end of at least one of the stop levers.

3. A franking machine according to claim 2, wherein at least two stop levers are fixed to the shaft, so that the movement of said stop levers is synchronized by means of the shaft.

4. A franking machine according to claim 1, wherein the delivery mechanism has at least one delivery lever mounted in the magazine on shafts for transferring the lifting motion of the armature rod of an electromagnet to the printing plate.

5. A franking machine according to claim 1, wherein the magazine is placed on at least one guide member and a detachable pawl keeps the magazine in a position for the delivery and reception of the printing plate counter to the tension of a spring.

6. A franking machine having a franking head, said franking head having franking wheels and a shaft connected thereto, said franking machine comprising;
   - a printing means having hook means defined therein;
   - at least one pair of movably attached ratchet levers, each lever having one hook which cooperates with said hook means of said printing means to releasably hold said printing means on said franking head and to release said printing means for movement upon rotation of said ratchet levers;

a cam body pivotally mounted in said franking head and associated with said ratchet levers such that rotation of said cam body results in movement of said ratchet levers and the corresponding unhooking of said ratchet levers from said printing means;

movably attached ejection levers associated with said cam body and said printing means such that upon rotation of said cam body and unhooking of said printing means, said ejection levers are moved against said printing means causing said printing means to move away from said franking head.

7. A franking machine according to claim 6, wherein the ratchet levers are mechanically coupled by the reciprocal engagement of one of their lever ends, at least one of the ratchet levers being pretensioned by a spring and a cam body forming part of the drive system engages on one end of one of the ratchet levers of a ratchet lever pair.

8. The franking machine of claim 6 further including a drive system comprising a gear and a shaft related thereto for driving said cam body;

a one way clutch associated with said gear and said franking head generally for adjustment of said franking wheels and said printing means; and an electromotive drive associated with said clutch and said shaft related to said gear.

9. The franking machine according to claim 6 further comprising a detachably secured magazine for receiving said printing plate, said magazine being arranged in a stationary manner on the circumference of said franking head;

a mechanism for the detachable mounting of said printing means, said mechanism being located in said magazine;

and a delivery mechanism provided for the automatic transfer of said printing means from said magazine to said latching means of said franking head.

10. The franking machine of claim 9 wherein said mechanism for the detachable mounting of said printing plate in said magazine comprises a stop lever;

a shaft and a latch fixed to said shaft;

said delivery mechanism further comprising at least one electromagnet having an armature rod for contact with one end of said stop lever.

11. The franking machine according to claim 10 wherein at least two stop levers are fixed to said shaft associated with said magazine such that the movement of said stop levers is synchronized with said shaft associated with said magazine.

12. The franking machine according to claim 9 wherein said delivery mechanism further comprises at least one delivery lever mounted in said magazine on said shaft for transferring the lifting motion of said armature rod of said electromagnet to said printing means.

13. The franking machine according to claim 9 further comprising a guide member and a detachable pawl, said magazine being placed on said guide member, said detachable pawl keeping said magazine in a position for the delivery and receipt of said printing means.

* * * * *